US005929397A

United States Patent [19]

Satoh et al.

[11] Patent Number: 5,929,397

[45] Date of Patent: Jul. 27, 1999

[54] INTAKE SILENCER SYSTEM

[75] Inventors: Kazunari Satoh; Masamichi Fujishiro, both of Wako; Michio Kijima, Kobe; Akio Okuno, Kobe; Katsuhiko Yokoyama, Kobe, all of Japan

[73] Assignees: Honda Giken Kogyo Kabushiki Kaisha, Tokyo; Tigers Polymer Corporation, Osaka, both of Japan

[21] Appl. No.: 09/132,675

[22] Filed: Aug. 12, 1998

[30] Foreign Application Priority Data

Aug. 13, 1997 [JP] Japan ..... 9-218418

[51] Int. Cl.[6] ..... F02M 35/00

[52] U.S. Cl. ..... 181/229; 181/282

[58] Field of Search ..... 181/229, 266, 181/269, 270, 272, 273, 276, 282; 123/184.57

[56] References Cited

U.S. PATENT DOCUMENTS 5,424,494 6/1995 Houle et al. ..... 181/229

5,647,314 7/1997 Matsumura et al. ..... 181/229

FOREIGN PATENT DOCUMENTS 8-158965 6/1996 Japan .

*Primary Examiner*—Khanh Dang

*Attorney, Agent, or Firm*—Nikaido, Marmelstein, Murray & Oram LLP

[57] ABSTRACT

The case of an intake silencer system includes a first case half and a second case half coupled to each other at mating faces, with an intake duct clamped between the mating faces. The intake duct opens into a resonant chamber within the case, so that noise is damped by a resonant effect. Three ribs are provided on an inner surface of the first case half, thereby defining four subsidiary silencing chambers each functioning as a side branch for producing a resonant effect to obtain a silencing effect in a wide frequency range. The ribs also contribute to an enhancement in rigidity of the wall surfaces of the case.

7 Claims, 6 Drawing Sheets

INTAKE SILENCER SYSTEM

BACKGROUND OF THE INVENTION

1. Field of the Invention

The present invention relates to an intake silencer system including an intake duct which communicates at opposite ends thereof with the atmospheric air and an engine, respectively, and whose intermediate portion opens into an intake silencing chamber.

2. Description of the Prior Art

An intake silencer system is known, for example, from Japanese Patent Application Laid-Open No. 8-158965. As shown in FIG. 6, in the known intake silencer system, a first silencing chamber 02 and a second silencing chamber 03 are defined in a case 01 by division of the inside of the case 01. A first intake duct 04 communicating with an engine and a second intake duct 05 communicating the atmospheric air, are opposed to each other, within the first silencing chamber 02. The second intake duct 05 communicates with the second silencing chamber 03 through a communication pipe 06. In this manner, a silencing function is obtained by the resonance effect of the first and second silencing chambers 02 and 03.

The above known system suffers from the following problem: Each of the first and second silencing chambers 02 and 03 exhibits a silencing effect only in a single frequency band. For this reason, to ensure that the silencing effect is exhibited in a wider frequency range, it is necessary to further increase the number of the silencing chambers, or to add a side branch. This is complicated and increases the size of the structure of an intake silencer system, resulting in an increased cost. Another problem of the above known system is that the wall surface of the case 01 is formed from a simple flat surface and thus has a low rigidity and hence, the wall surface is vibrated to thereby increase the radiated sound.

SUMMARY OF THE INVENTION

Accordingly, it is an object of the present invention to provide an intake silencer system which is capable of exhibiting a silencing effect over a wide frequency range while maintaining a simple and compact structure, and moreover, wherein the rigidity of a wall surface of a case can be enhanced to inhibit the generation of a radiated sound.

To achieve the above object, according to the present invention, there is provided an intake silencer system comprising an intake duct which communicates at opposite ends thereof with the atmospheric air and an engine, respectively, and whose intermediate portion opens into an intake silencing chamber. The intake silencer system further includes a plurality of subsidiary silencing chambers which are defined within the intake silencing chamber by integrally connecting the opposed wall surfaces of the intake silencing chamber to each other with a plurality of ribs, the subsidiary silencing chambers being closed at one end thereof and opened at the other end directly into the intake silencing chamber. The silencing chambers have different resonance frequencies.

With the above arrangement, the plurality of subsidiary silencing chambers having the different resonance frequencies, can be formed in a simple and compact structure in which the opposed wall surfaces of the intake silencing chamber are integrally connected to each other by the plurality of ribs. Therefore, a silencing effect over a wide frequency range can be obtained by the resonance effect of each of the subsidiary silencing chambers, each functioning as a side branch. Moreover, the rigidity of the wall surfaces of the intake silencing chamber is enhanced by the plurality of ribs and hence, it is possible to effectively inhibit the generation of a radiated sound due to the vibration of the wall surfaces.

If some of the wall surfaces have an area larger than that of other wall surfaces of the intake silencing chamber, the wall surface rigidity which would have been decreased because of its larger area can be reinforced by the ribs to further effectively inhibit the generation of the radiated sound, and also the size of the ribs can be maintained to the minimum.

The intake silencing chamber may comprise a first case half and a second case half with mating faces thereof coupled to each other to clamp the intake duct, and the plurality of subsidiary silencing chambers defined in the first case half, may open towards the mating faces. With the above arrangement, when the first case half is formed in a mold, the plurality of subsidiary silencing chambers can be formed simultaneously, leading to an enhanced productivity.

The plurality of subsidiary silencing chambers and the intake duct are disposed on opposite sides of the intake silencing chamber in a horizontal direction. With the above arrangement, the intake duct is prevented from interfering with the ribs and hence, the size of the ribs is not limited, leading to an increased freedom in determining the sizes and shapes of the subsidiary silencing chambers.

BRIEF DESCRIPTION OF THE DRAWINGS

The above and other objects, features and advantages of the invention will become apparent from the following description of the preferred embodiment taken in conjunction with the accompanying drawings.

FIG. 1 is a perspective view of the entire intake silencer system according to the embodiment of the present invention.

FIG. 2 is a view taken along a line 2—2 in FIG. 1.

FIG. 3 is a sectional view taken along a line 3—3 in FIG. 2.

FIG. 4 is a sectional view taken along a line 4—4 in FIG. 2.

FIG. 5 is a graph for explaining the silencing effect.

DETAILED DESCRIPTION OF THE PREFERRED EMBODIMENT

Figure 1:
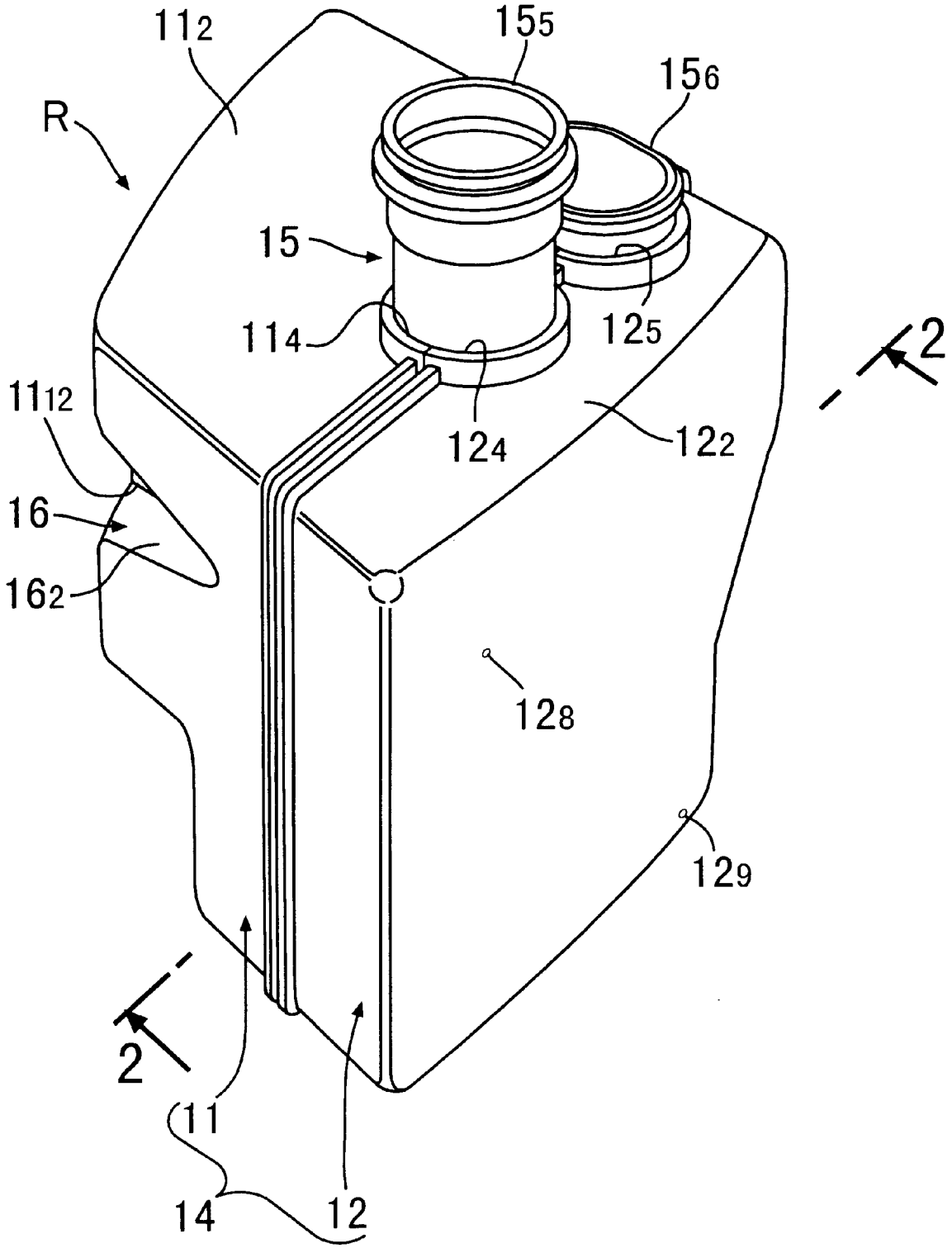
FIGS. 1 to 5 show an embodiment of the present invention.

The present invention will now be described by way of an embodiment with reference to FIGS. 1 to 5.

An intake silencer system R mounted in an intake system of an engine of an automobile, comprises a case 14 which is made of a synthetic resin. The case 14 comprises a first case half 11 and a second case half 12 integrally coupled to each other at mating faces 13 extending in a vertical direction. An intake duct 15 which is made in a J-shape, of a synthetic resin, is clamped between the mating faces 13 of the first case half 11 and the second case half 12. The first case half 11 has a volume larger than that of the second case half 12 and includes a wedge-shaped recess 16 which is defined at a location spaced one third of the way down from an upper surface of the first case half 11, and extends toward the mating faces 13. A first partition wall $\mathbf{11}_1$ extends horizontally from the tip end of the wedge-shaped recess 16 towards the mating faces 13. The tip end of the first partition wall $\mathbf{11}_1$ is coupled to a tip end of a second partition wall $\mathbf{12}_1$, extending horizontally from an inner surface of the second case half 12 toward the mating faces 13. As a result, a first resonant chamber 17 forming an intake silencing chamber of the present invention, is defined between upper-side case upper walls $\mathbf{11}_2$ and $\mathbf{12}_2$ and a lower-side recess upper wall $\mathbf{16}_1$ as well as the first and second partition walls $\mathbf{11}_1$ and $\mathbf{12}_1$, and a second resonant chamber 18 is defined between lower-side case lower walls $\mathbf{11}_3$ and $\mathbf{12}_3$ and an upper-side recess lower wall $\mathbf{16}_2$ as well as the first and second partition walls $\mathbf{11}_1$ and $\mathbf{12}_1$.

Figure 2:
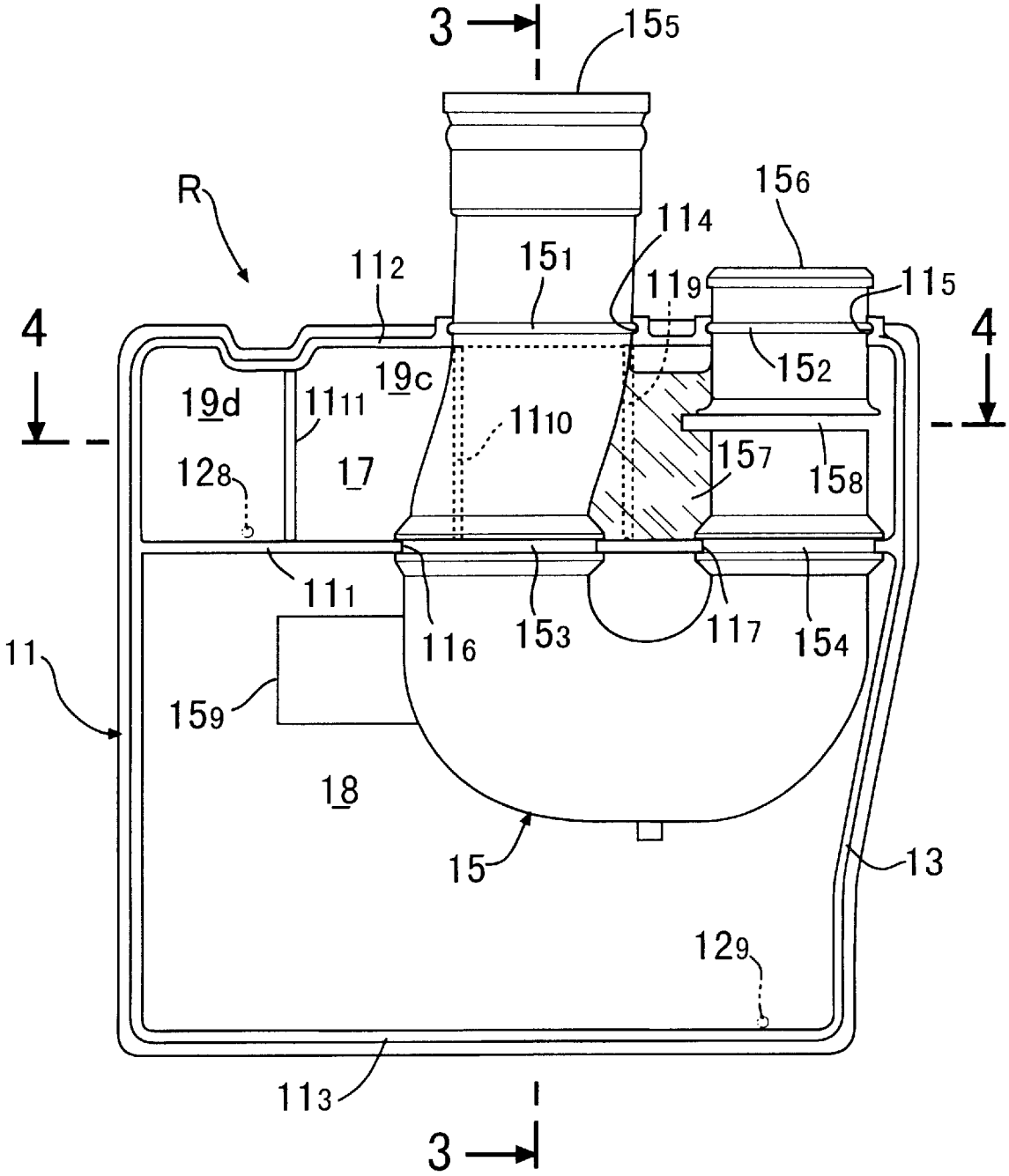
Figure 3:
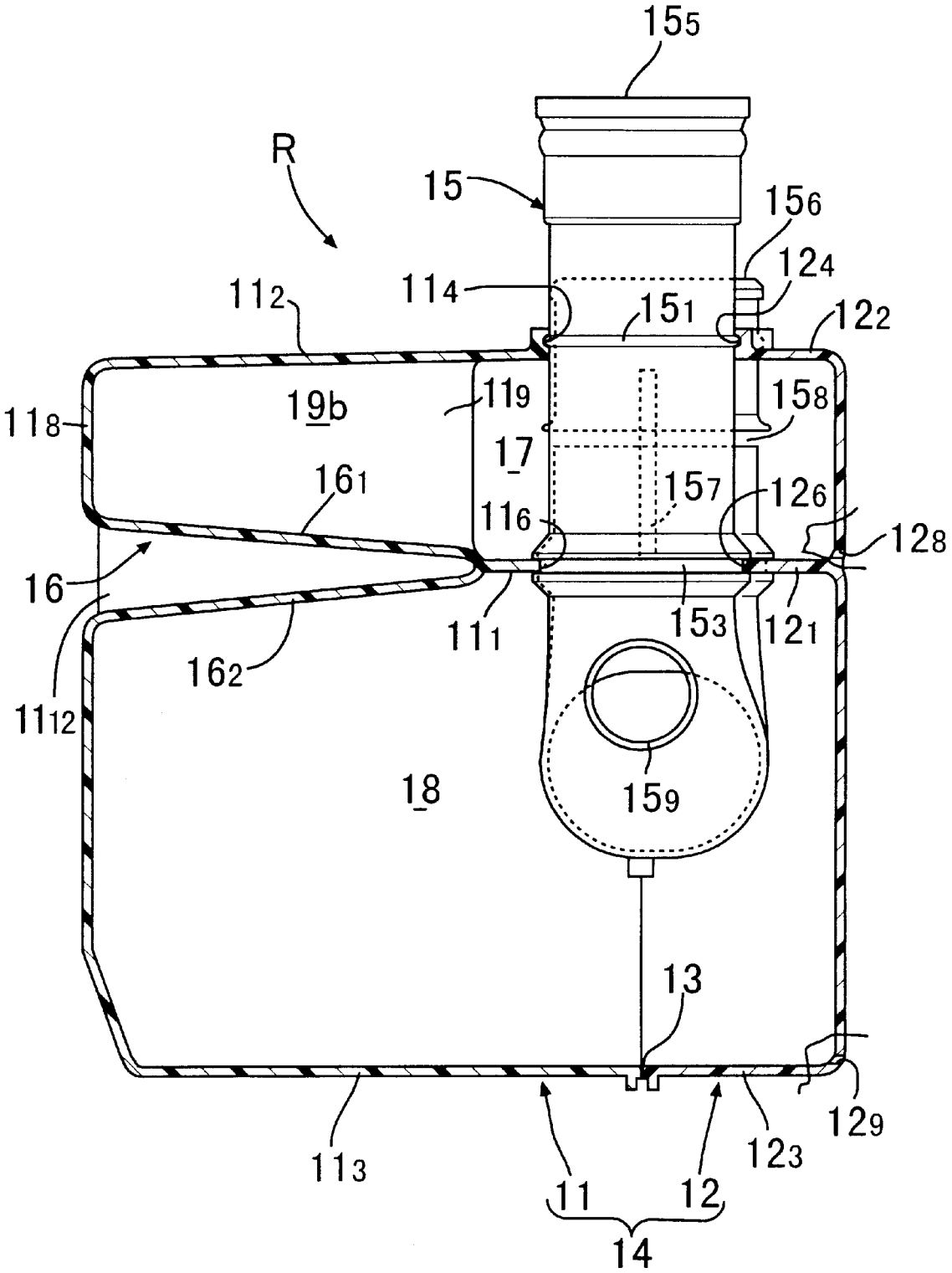
Figure 4:
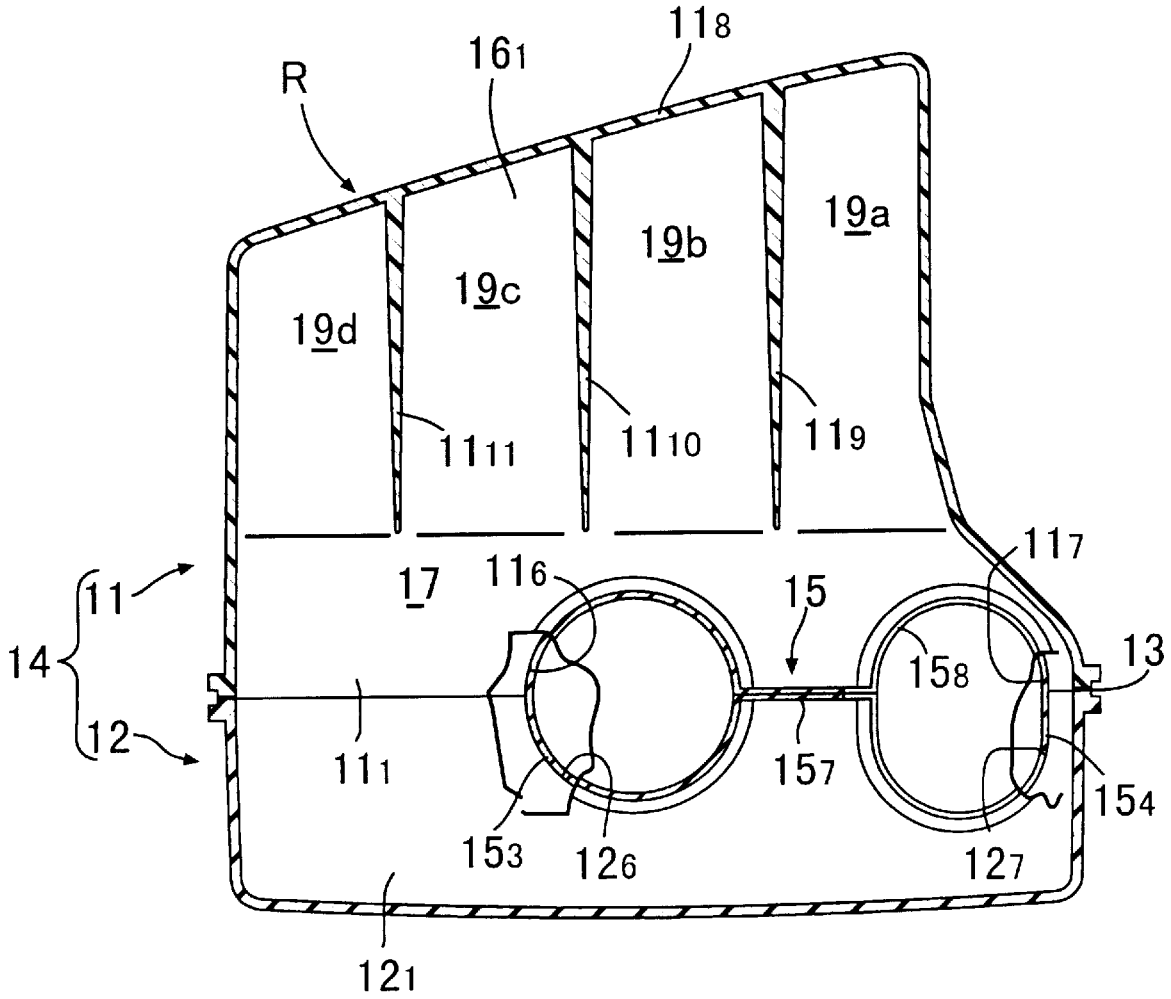

A pair of annular projections $\mathbf{15}_1$ and $\mathbf{15}_2$ are formed around an outer periphery of an upper portion of the intake duct 15 and interposed between a pair of notches $\mathbf{11}_4$ and $\mathbf{11}_5$ defined in the case upper wall $\mathbf{11}_2$ of the first case half 11 and a pair of notches $\mathbf{12}_4$ and $\mathbf{12}_5$ defined in the case upper wall $\mathbf{12}_2$ of the second case half 12 (see FIGS. 1 and 2). A pair of annular recesses $\mathbf{15}_3$ and $\mathbf{15}_4$ are defined around an outer periphery of a lower portion of the intake duct 15 and interposed between a pair of notches $\mathbf{11}_6$ and $\mathbf{11}_7$ defined in the first partition wall $\mathbf{11}_1$ of the first case half 11 and a pair of notches $\mathbf{12}_6$ and $\mathbf{12}_7$ defined in the second partition wall $\mathbf{12}_1$ of the second case half 12 (see FIGS. 2 and 4). The intake duct 15 is firmly clamped between the first case half 11 and the second case half 12, and an air inlet $\mathbf{15}_5$ communicating with the atmospheric air through an air cleaner (now shown) and an air outlet $\mathbf{15}_6$ communicating with a throttle body of the engine (not shown) protrude upwards from the case upper walls $\mathbf{11}_2$ and $\mathbf{12}_2$.

The J-shaped intake duct 15 has portions located within the first resonant chamber 17, connected to each other by a connecting wall $\mathbf{15}_7$, and a slit-like opening $\mathbf{15}_8$ is formed therein for permitting the inside of the intake duct 15 to communicate with the inside of the first resonant chamber 17, the opening $\mathbf{15}_8$ being formed by cutting a portion near the air outlet $\mathbf{15}_6$ up to a location reaching the connecting wall $\mathbf{15}_7$. The intake duct 15 includes a communication pipe $\mathbf{15}_9$ at a portion located within the second resonant chamber 18, so that the inside of the intake duct 15 communicates with the inside of the second resonant chamber 18 through the communication pipe $\mathbf{15}_9$.

Three ribs $\mathbf{11}_9$, $\mathbf{11}_{10}$ and $\mathbf{11}_{11}$ are formed in parallel to one another within the first resonant chamber 17. The ribs $\mathbf{11}_9$, $\mathbf{11}_{10}$ and $\mathbf{11}_{11}$ are connected to the case upper walls $\mathbf{11}_2$, the recess upper wall $\mathbf{16}_1$ and a case sidewall $\mathbf{11}_8$ and extend toward the mating faces 13. Four subsidiary silencing chambers 19*a*, 19*b*, 19*c* and 19*d* are defined in a divided manner within the first resonant chamber 17 and open toward the mating faces 13. The sizes and shapes of the four subsidiary silencing chambers 19*a*, 19*b*, 19*c* and 19*d* are different from one another, so that they each have different resonance frequencies. A plurality of ribs $\mathbf{11}_2$ are provided in the wedge-shaped recess 16 of the first case half 11 to connect the recess upper wall $\mathbf{16}_1$ and the recess lower wall $\mathbf{16}_2$ to each other. The second case half 12 has two water scupper bores $\mathbf{12}_8$ and $\mathbf{12}_9$ for discharging water from the first and second resonant chambers 17 and 18.

The operation of the embodiment of the present invention having the above-described arrangement will be described below.

The open air drawn by a negative intake pressure generated by the operation of the engine, is supplied to the engine through the air cleaner (not shown), the intake duct 15 of the intake silencer system R and the throttle body (not shown). At this time, the inside of the intake duct 15 communicates with the inside of the first resonant chamber 17 through the opening $\mathbf{15}_8$ and with the inside of the second resonant chamber 18 through the communication pipe $\mathbf{15}_9$ and hence, noises of two different frequency bands can be damped by the first and second resonant chambers 17 and 18 each functioning as a resonant-type silencer. As can be seen from FIG. 5, the second resonant chamber 18 having a large volume, dampens the noise of a relatively low frequency band, and the first resonant chamber 17 having a smaller volume than that of the second resonant chamber 18, dampens the noise of a higher frequency band.

Figure 5:
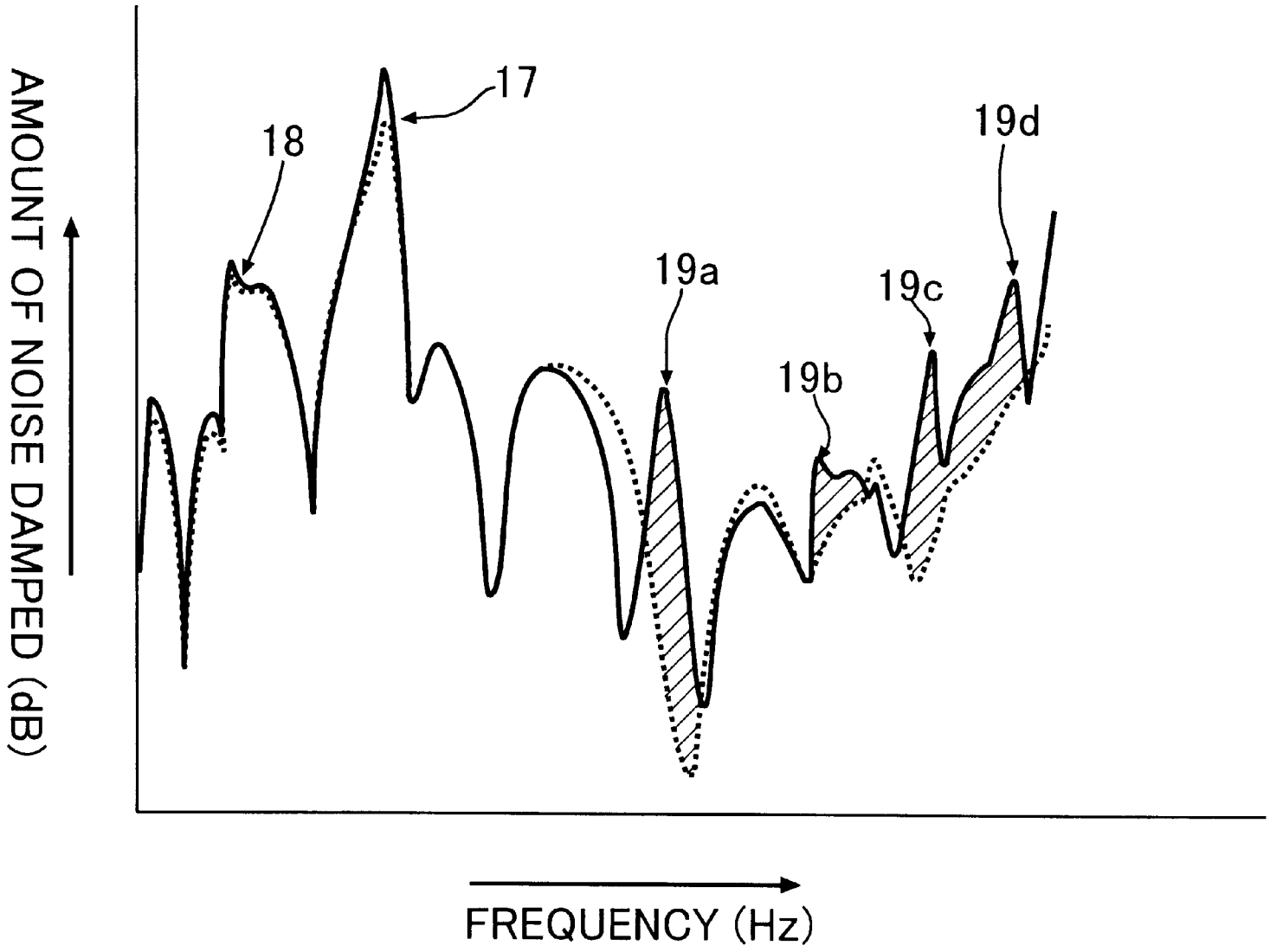
Figure 6:
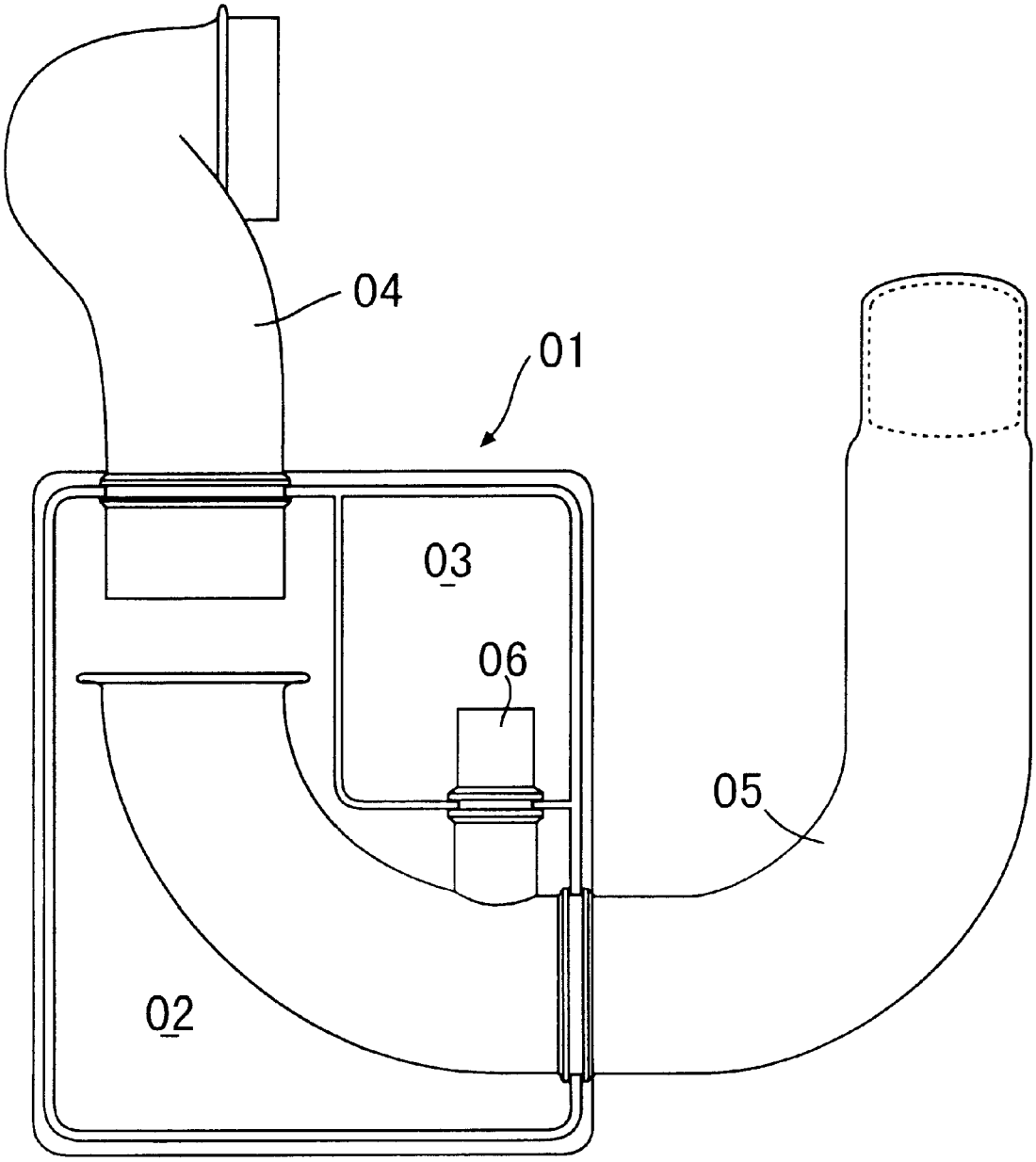
FIG.6 PRIOR ART
FIG. 6 is a sectional view of a prior art intake silencer system.

At the same time, each of the four subsidiary silencing chambers 19*a*, 19*b*, 19*c* and 19*d* separated from one another by the three ribs $\mathbf{11}_9$, $\mathbf{11}_{10}$ and $\mathbf{11}_{11}$ within the first resonant chamber 17, functions as a side branch having a resonant effect and is capable of damping noise of a frequency band depending upon the size and shape thereof. The four subsidiary silencing chambers 19*a*, 19*b*, 19*c* and 19*d* are decreased in volume in the order of 19*a*→19*b*→19*c*→19*d* and hence, are capable of damping the noises of a lower frequency band to a higher frequency band in the above-described order, respectively, as shown by a solid line in FIG. 5. A dashed line in FIG. 5 shows a silencing effect provided when the first resonant chamber 17 dose not have the ribs $\mathbf{11}_9$, $\mathbf{11}_{10}$ and $\mathbf{11}_{11}$ (namely, the subsidiary silencing chambers 19*a*, 19*b*, 19*c* and 19*d*). If the silencing effect shown by the dashed line is compared with that shown by the solid line, the noise damping effects (see obliquely lined areas) provided by the subsidiary silencing chambers 19*a*, 19*b*, 19*c* and 19*d* can be confirmed.

In this way, it is possible to effectively dampen the noise of a frequency band wider than that of the prior art without an increase in size of the intake silencer system R using a simple structure in which the plurality of ribs $\mathbf{11}_9$, $\mathbf{11}_{10}$ and $\mathbf{11}_{11}$ are formed only within the first resonant chamber 17. Moreover, the ribs $\mathbf{11}_9$, $\mathbf{11}_{10}$ and $\mathbf{11}_{11}$ integrally connect the three wall surfaces of the first resonant chamber 17, i.e., the case upper wall $\mathbf{11}_2$, the recess upper wall $\mathbf{16}_1$ and the case sidewall $\mathbf{11}_8$, and hence, it is possible to remarkably enhance the rigidity of the first case half 11, and prevent the generation of a radiated sound due to the vibration of the wall surfaces $\mathbf{11}_1$, $\mathbf{11}_8$ and $\mathbf{16}_1$.

Particularly, the ribs $\mathbf{11}_9$ to $\mathbf{11}_{11}$ integrally connect the two largest opposed wall surfaces of the first resonant chamber 17 (namely, the upper-side case upper wall $\mathbf{11}_2$ and the lower-side recess upper wall $\mathbf{16}_1$) and hence, it is possible to effectively inhibit the radiated sound from the case upper wall $\mathbf{11}_2$ which is liable to be vibrated because of its large area, and the radiated sound from the recess upper wall $\mathbf{16}_1$. Further, because the distance between the case upper wall $\mathbf{11}_2$ and the recess upper wall $\mathbf{16}_1$ is relatively small, the height of the ribs $\mathbf{11}_9$ to $\mathbf{11}_{11}$ can be reduced. Thus, the rigidity of the ribs $\mathbf{11}_9$ to $\mathbf{11}_{11}$ themselves can be enhanced, and also the thickness of the ribs $\mathbf{11}_9$ to $\mathbf{11}_{11}$ can be reduced to minimize an increase in weight.

The first case half 11 and the second case half 12 are made from a synthetic resin by an injection molding, wherein the ribs $\mathbf{11}_9$ to $\mathbf{11}_{11}$ and $\mathbf{11}_{12}$ are formed in a direction perpendicular to the mating face 13 corresponding to a parting face of a mold for forming the first case half 11. Therefore, it is easy to release the formed first case half 11 from the mold, and the structure of the mold can be simplified. Also the four subsidiary silencing chambers 19*a*, 19*b*, 19*c* and 19*d* can be formed without subjecting the formed first case half 11 to a special treatment.

By the fact that the intake duct 15 is clamped between and fixed to the mating faces 13 of the first case half 11 and the second case half 12, a special member such as a bolt or the like is not required for such fixing. Moreover, as can be seen from FIG. 4, the mating faces 13 clamping the intake duct 15, are offset remotely from the ribs $\mathbf{11}_9$ to $\mathbf{11}_{11}$ with respect to the central portion of the intake silencer system R. Therefore, the subsidiary silencing chambers 19*a* to 19*d* having a sufficient volume, can be formed without consideration of the interference of the ribs $\mathbf{11}_9$ to $\mathbf{11}_{11}$ with the intake duct 15.

The four subsidiary silencing chambers 19*a*, 19*b*, 19*c* and 19*d* are defined by the three ribs $\mathbf{11}_9$, $\mathbf{11}_{10}$ and $\mathbf{11}_{11}$ in the embodiment shown, but the number of the ribs may be two or more.

Although the embodiment of the present invention has been described in detail, it will be understood that the present invention is not limited to the above-described embodiments, and various modifications in design may be made without departing from the spirit and scope of the invention defined in claims.

We claim:

1. An intake silencer system for an engine comprising an intake silencing chamber, an intake duct communicating at one end thereof with the atmosphere and at the other end thereof with the engine, said intake duct having an intermediate portion opening into said intake silencing chamber, a plurality of ribs, and a plurality of subsidiary silencing chambers defined within said intake silencing chamber wherein opposed wall surfaces of said intake silencing chamber are integrally connected to each other by said plurality of ribs, said subsidiary silencing chambers being closed at one end thereof and opened at the other end directly into said intake silencing chamber, and wherein said subsidiary silencing chambers have different resonance frequencies.

2. An intake silencer system according to claim 1, wherein at least one of said wall surfaces of said intake silencing chamber has a surface area larger than the surface area of at least one other wall surface of said intake silencing chamber.

3. An intake silencer system according to claim 2, wherein said intake silencing chamber comprises a first case half and a second case half having mating faces, wherein said mating faces thereof are coupled to each other to clamp said intake duct, and the plurality of subsidiary silencing chambers are defined in said first case half and open toward said mating faces.

4. An intake silencer system according to claim 3, wherein said plurality of subsidiary silencing chambers are disposed on one side of said intake silencing chamber and said intake duct is disposed on the other side of said intake silencing chamber, in a horizontal direction.

5. An intake silencer system according to claim 2, wherein said plurality of subsidiary silencing chambers are disposed on one side of said intake silencing chamber and said intake duct is disposed on the other side of said intake silencing chamber, in a horizontal direction.

6. An intake silencer system according to claim 1, wherein said intake silencing chamber comprises a first case half and a second case half having mating faces, wherein said mating faces thereof are coupled to each other to clamp said intake duct, and the plurality of subsidiary silencing chambers are defined in said first case half and open toward said mating faces.

7. An intake silencer system according to claim 1, wherein said plurality of subsidiary silencing chambers are disposed on one side of said intake silencing chamber and said intake duct is disposed on the other side of said intake silencing chamber, in a horizontal direction.

* * * * *